US010765280B2

(12) United States Patent
Kim et al.

(10) Patent No.: US 10,765,280 B2
(45) Date of Patent: Sep. 8, 2020

(54) VACUUM CLEANER AND CONTROL METHOD FOR THE SAME

(71) Applicant: Samsung Electronics Co., Ltd., Gyeonggi-do (KR)

(72) Inventors: Dong Wook Kim, Incheon (KR); Ki Hwan Kwon, Hwaseong-si (KR); Jin Wook Yoon, Yongin-si (KR); Dong Woo Ha, Hwaseong-si (KR); Seok Man Hong, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 105 days.

(21) Appl. No.: 15/540,014

(22) PCT Filed: Dec. 22, 2015

(86) PCT No.: PCT/KR2015/014084
§ 371 (c)(1),
(2) Date: Nov. 7, 2017

(87) PCT Pub. No.: WO2016/105076
PCT Pub. Date: Jun. 30, 2016

(65) Prior Publication Data

US 2018/0042438 A1 Feb. 15, 2018

(30) Foreign Application Priority Data

Dec. 26, 2014 (KR) ..... 10-2014-0190408

(51) Int. Cl.
*A47L 9/00* (2006.01)
*A47L 9/28* (2006.01)
*A47L 5/22* (2006.01)

(52) U.S. Cl.
CPC ..... *A47L 9/0081* (2013.01); *A47L 5/22* (2013.01); *A47L 9/00* (2013.01); *A47L 9/2826* (2013.01);
(Continued)

(58) Field of Classification Search
CPC ..... A47L 2201/04; A47L 5/22; A47L 9/00; A47L 9/0081; A47L 9/2826; A47L 9/2852; A47L 2201/00
See application file for complete search history.

(56) References Cited

U.S. PATENT DOCUMENTS 5,499,423 A * 3/1996 Joo ..... A47L 9/0081 15/319
6,234,758 B1 * 5/2001 Pawelski ..... F04B 11/0016 417/26
(Continued)

FOREIGN PATENT DOCUMENTS

CN 1969728 A 5/2007
CN 202391618 U 8/2012
(Continued)

OTHER PUBLICATIONS

Machine translation of JP2012-128230A dated Jul. 2012 (Year: 2012).*
(Continued)

*Primary Examiner* — Douglas Lee

(57) ABSTRACT

Disclosed is a vacuum cleaner including a flow path to guide air suctioned or discharged and a resonator connected to the flow path. The resonator is configured to change a resonance frequency to be canceled. Therefore, when the noise generated by changing operation modes of the vacuum cleaner is changed, the noise may be cancelled by changing the resonance frequency of the resonator.

18 Claims, 11 Drawing Sheets

(52) U.S. Cl.
CPC ..... *A47L 9/2852* (2013.01); *A47L 2201/00* (2013.01); *A47L 2201/04* (2013.01)

(56) References Cited

U.S. PATENT DOCUMENTS

| | | | |
|---|---|---|---|
| 2004/0071546 | A1 | 4/2004 | Werner et al. |
| 2012/0311814 | A1 | 12/2012 | Kah, Jr. |

FOREIGN PATENT DOCUMENTS

| | | | | | |
|---|---|---|---|---|---|
| CN | 103590936 | A | | 2/2014 | |
| CN | 103590936 | A | * | 2/2014 | |
| EP | 1407659 | A1 | | 4/2004 | |
| GB | 2151504 | A | * | 7/1985 | ..... B01D 53/265 |
| GB | 2468153 | A | | 9/2010 | |
| GB | 2468153 | A | * | 9/2010 | ..... A47L 9/0081 |
| JP | 63179174 | A | * | 7/1988 | |
| JP | 05195746 | A | * | 8/1993 | ..... F01N 1/023 |
| JP | H05195746 | A | | 8/1993 | |
| JP | 2007113476 | A | | 5/2007 | |
| JP | 2012128230 | A | * | 7/2012 | |
| JP | 2013172807 | A | | 9/2013 | |
| KR | 1020050115962 | | | 12/2005 | |
| WO | 2013062212 | A1 | | 5/2013 | |

OTHER PUBLICATIONS

Abstract of JP63-179174A dated Jul. 1988 (Year: 1988).*

Foreign Communication from Related Counterpart Application; European Patent Application No. 15873603.3; Extended European Search Report and European Search Opinion dated Dec. 13, 2017; 6 pages.

Park et al., "Low-Frequency Noise Reduction in an Enclosure by Using a Helmholtz Resonator Array", Transactions of the Korean Society for Noise and Vibration Engineering, vol. 22 No. 8, 2012, pp. 756-762.

China National Intellectual Property Administration, "Text of the First Office Action," Application No. CN201580076065.7, dated Aug. 2, 2019, 25 pages.

Office Action dated Jun. 23, 2020 in connection with Chinese Patent Application No. 201580076065.7, 20 pages.

* cited by examiner

VACUUM CLEANER AND CONTROL METHOD FOR THE SAME

CROSS-REFERENCE TO RELATED APPLICATIONS AND CLAIM OF PRIORITY

The present application claims priority under 35 U.S.C. § 365 to International Patent Application No. PCT/KR2015/014084 filed Dec. 22, 2015, entitled "VACUUM CLEANER AND CONTROL METHOD THEREFOR", and through Korean Patent Application No. 10-2014-0190408, which was filed on Dec. 26, 2014, each of which is incorporated herein by reference into the present disclosure as if fully set forth herein.

TECHNICAL FIELD

Embodiments of the present disclosure relate to a vacuum cleaner to reduce a noise generated when cleaning and a control method for the same.

BACKGROUND

In general, a vacuum cleaner is an apparatus configured to perform a clean by suctioning foreign materials, e.g., dust together with air using a suction force generated by a fan rotated by a motor, and by collecting the dust by separating the foreign materials contained in the suctioned air from the air.

The vacuum cleaner includes a general vacuum cleaner configured to perform a clean such that a user moves it by directly applying a force and a robot cleaner configured to perform a clean by automatically moving without the user operation.

When the vacuum cleaner performs a clean, the noise is inevitably generated in a process of suctioning and discharging air through a flow path inside the main body.

SUMMARY

Therefore, it is an aspect of the present disclosure to provide a vacuum cleaner having a resonator capable of efficiently canceling a noise generated during air passes through a flow path inside the vacuum cleaner, when cleaning, and a control method for the same.

In accordance with one aspect of the present disclosure, a vacuum cleaner includes a suction unit configured to suction and discharge air, at least one flow path configured to guide air to be suctioned into the suction unit or to be discharged from the suction unit, and at least one resonator connected to the at least one flow path to cancel a noise, wherein the at least one resonator is configured to change a resonant frequency to be cancelled.

The resonator may include a resonance container formed in a hollow container shape to form a resonance space and a piston installed to be movable forward and backward in the resonance container.

The vacuum cleaner may further include a driving device configured to move the piston forward and backward.

The driving device may include a driving motor, a pinion rotated by the driving motor, and a rack connected to the piston and engaged with the pinion.

The vacuum cleaner may further include a lever configured to transmit an external force to the piston.

The at least one flow path may include a suction flow path configured to guide air suctioned into the suction unit and a discharge flow path configured to guide air discharged from the suction unit, wherein the at least one resonator is installed in at least one of the suction flow path and the discharge flow path.

The resonator may include a resonance container formed in a hollow container shape to form a resonance space and a connection pipe configured to connect the flow path to the resonance container, wherein a length of the connection pipe is variable.

The connection pipe may include a first connection pipe extending from the flow path and a second connection pipe extending from the resonance container and movably installed in the first connection pipe.

The at least one flow path may include a main flow path and a bypass flow path diverged from the main flow path and then joined into the main flow path, wherein the resonator is connected to the bypass flow path.

The resonator may include a resonance container formed by an expandable and contractible bellows tube.

In accordance with another aspect of the present disclosure, a vacuum cleaner includes at least one flow path configured to guide suction or discharge of air, and at least one resonator connected to the at least one flow path, wherein the resonator comprises a resonance container configured to change a volume of an internal space thereof forming a resonance space.

The vacuum cleaner may further include a piston installed to be movable in the resonance container and configured to change the volume of the resonance space while moving.

The resonance container may be formed by an expandable and contractible bellows tube.

In accordance with another aspect of the present disclosure, a vacuum cleaner includes at least one flow path configured to guide suction or discharge of air, and at least one resonator connected to the at least one flow path, wherein the resonator comprises a resonance container forming a resonance space and a connection pipe connecting the flow path to the resonance container, wherein a length of the connection pipe is variable.

The connection pipe comprises a first connection pipe extending from the flow path and a second connection pipe extending from the resonance container and movably installed in the first connection pipe.

In accordance with another aspect of the present disclosure, a control method for a vacuum cleaner includes allowing air to flow via a flow path by driving a suction unit, detecting a frequency of noise generated in the flow path during the air flows, and changing a resonant frequency of a resonator connected to the flow path so that the resonant frequency corresponds to the frequency of the noise.

The resonator may include a resonance container formed in a hollow container shape to form a resonance space therein, wherein the change in the resonant frequency of the resonator is performed according to the change in a volume of the resonance space.

The resonator may include a connection pipe configured to connect the flow path to the resonance container, wherein the change in the resonant frequency of the resonator is performed according to the change in a length of the connection pipe.

In accordance with one aspect of the present disclosure, it may be possible to actively cope with a noise which is generated with various levels according to an operation mode of a vacuum cleaner, since the vacuum cleaner has a resonator capable of changing a resonate frequency.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Hereinafter, a vacuum cleaner according to a first embodiment of the present disclosure will be described in detail with reference to drawings.

In this embodiment, a robot cleaner configured to clean a floor while automatically traveling without the user operation will be described as an example of a vacuum cleaner.

Figure 1:
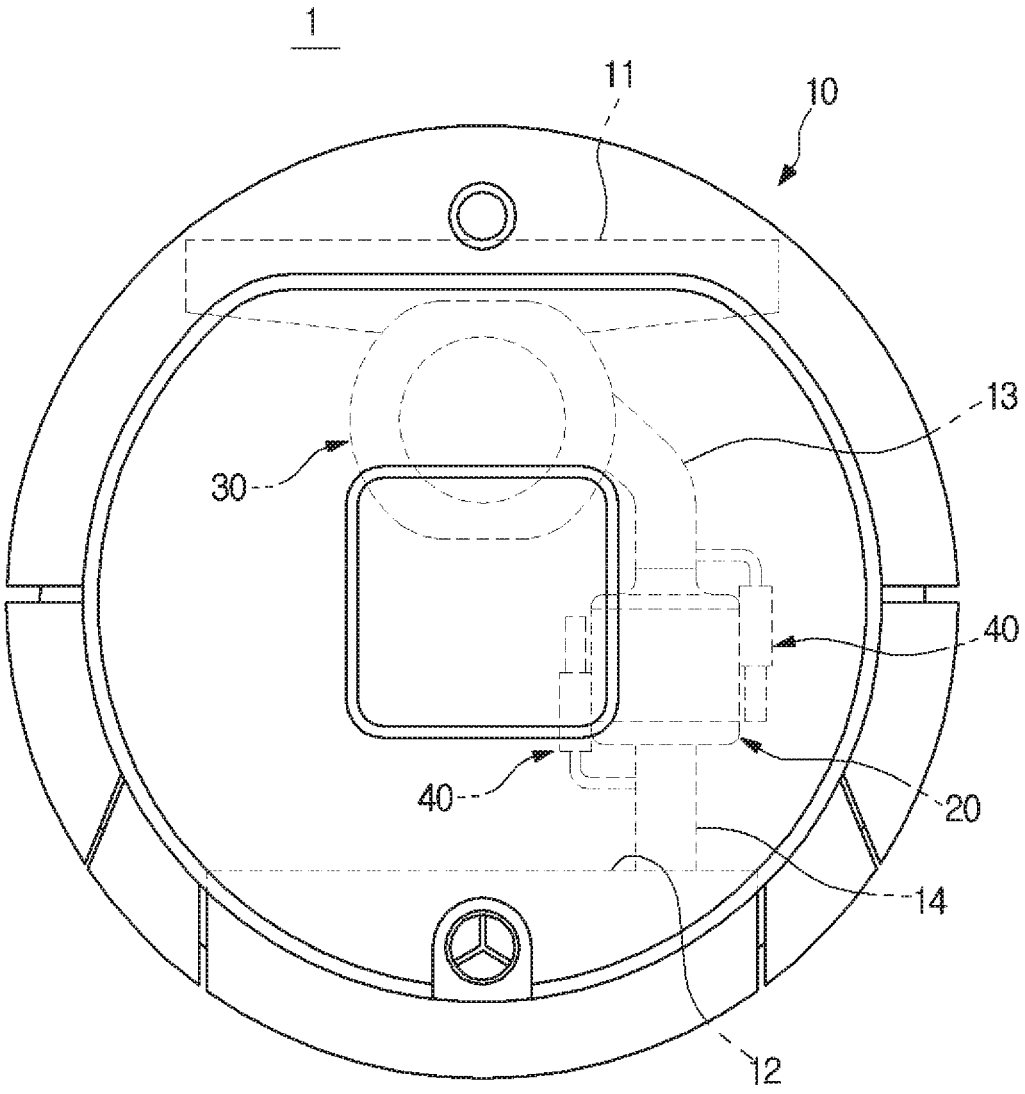
FIG. 1 is a schematic view illustrating a vacuum cleaner according to a first embodiment of the present disclosure.

As illustrated in FIG. 1, a vacuum cleaner 1 may include a body 10 formed in a substantially disk shape to form an exterior of the vacuum cleaner 1; a suction unit 20 disposed inside of the body 10 to allow the outside air together with foreign materials to be suctioned into the inside of the body 10 and to be discharged; and a dust collector 30 configured to filter the foreign materials, e.g., dust, contained in the air suctioned by the suction unit 20.

An inlet 11 to which the air is suctioned, and an outlet 12 to which the air in which the foreign material is filtered is discharged may be disposed in the body 10. A flow path 13 and 14 configured to guide the air suctioned via the inlet 11 to be discharged via the outlet 12 by passing through the dust collector 30 and the suction unit 20 may be provided inside of the body 10. The inlet 11 may be provided in the lower front side of the body 10 and the inlet 11 may be provided in the rear side of the body 10.

The flow path 13 and 14 may include a suction flow path 13 configured to guide the air suctioned via the inlet 11, to the suction unit 20, and a discharge flow path 14 configured to guide the air discharged from the suction unit 20, to the outlet 12.

A resonator 40 may be connected to the flow path 13 and 14 to cancel a noise generated during the air is suctioned or discharged. According to the embodiment, two resonators 40 may be provided and thus one resonator 40 may be connected to the suction flow path 13 and the other resonator 40 may be connected to the discharge flow path 14. Therefore, it is possible to separately cancel the noise generated in the process of suctioning air through the suction flow path 13 and the noise generated in the process of discharging the air through the discharge flow path 14.

The dust collector 30 may be disposed adjacent to the inlet 11 and configured to allow the foreign materials, which are contained in the air introduced via the inlet 11, to be filtered before transmitted to the suction unit 20. A component, e.g., a filter (not shown) may be disposed inside of the dust collector 30.

Figure 2:
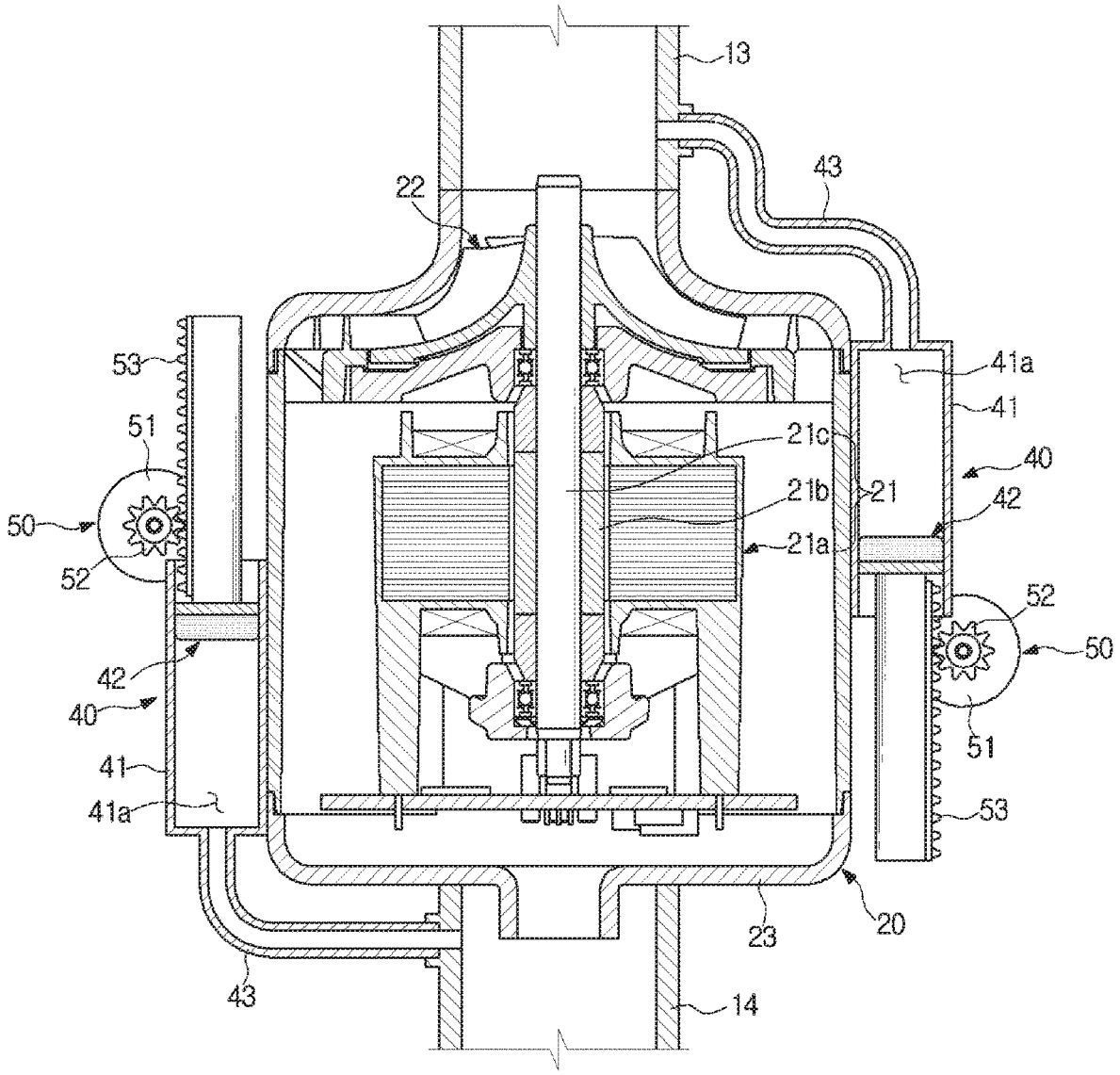
FIG. 2 is a sectional view illustrating a suction unit and a resonator applied to a vacuum cleaner according to the first embodiment of the present disclosure.

As illustrated in FIG. 2, the suction unit 20 may include a motor 21 configured to generate a torque by including a stator 21*a*, a rotor 21*b* and an axis 21*c*; a blowing fan 22 connected to the axis 21*c* of the motor 21 to be rotated to move the air along the flow path 13 and 14; and a housing 23 configured to accommodate the motor 21 and the blowing fan 22.

According to the embodiment, since the motor 21 applied to the suction unit 20 is configured to adjust the number of revolutions, it is possible to change the suction force and the blowing force generated by the suction unit 20. This is to allow the vacuum cleaner 1 to operate in various modes depending on a cleaning environment, e.g., a floor condition or a user's selection.

For example, the vacuum cleaner 1 may be operated in an operation mode, wherein the operation mode may include a quite cleaning mode for minimizing the noise generated in the vacuum cleaner 1 despite of a weak suction force, a regular cleaning mode for cleaning a general floor with a normal suction force, a carpet cleaning mode for cleaning the carpet, and a power cleaning mode for cleaning the floor with a stronger suction force despite of generating a loud noise.

According to the change in the operation mode as mentioned above, the suction force and the blowing force generated by the suction unit 20 may vary, and thus the frequency of the noise generated by the suction unit 20 may vary according to the change in the suction force and the blowing force.

When the resonator 40 is configured to cancel a certain frequency, it may be impossible to correspond to the noise changed according to the change in the operation mode of the vacuum cleaner 1.

Therefore, according to the embodiment of the present disclosure, the resonator 40 may be configured to change a resonant frequency to cancel the noise and thus it may be possible to actively deal with the noise variably changed according to the change in the operation mode of the vacuum cleaner 1.

Figure 3:
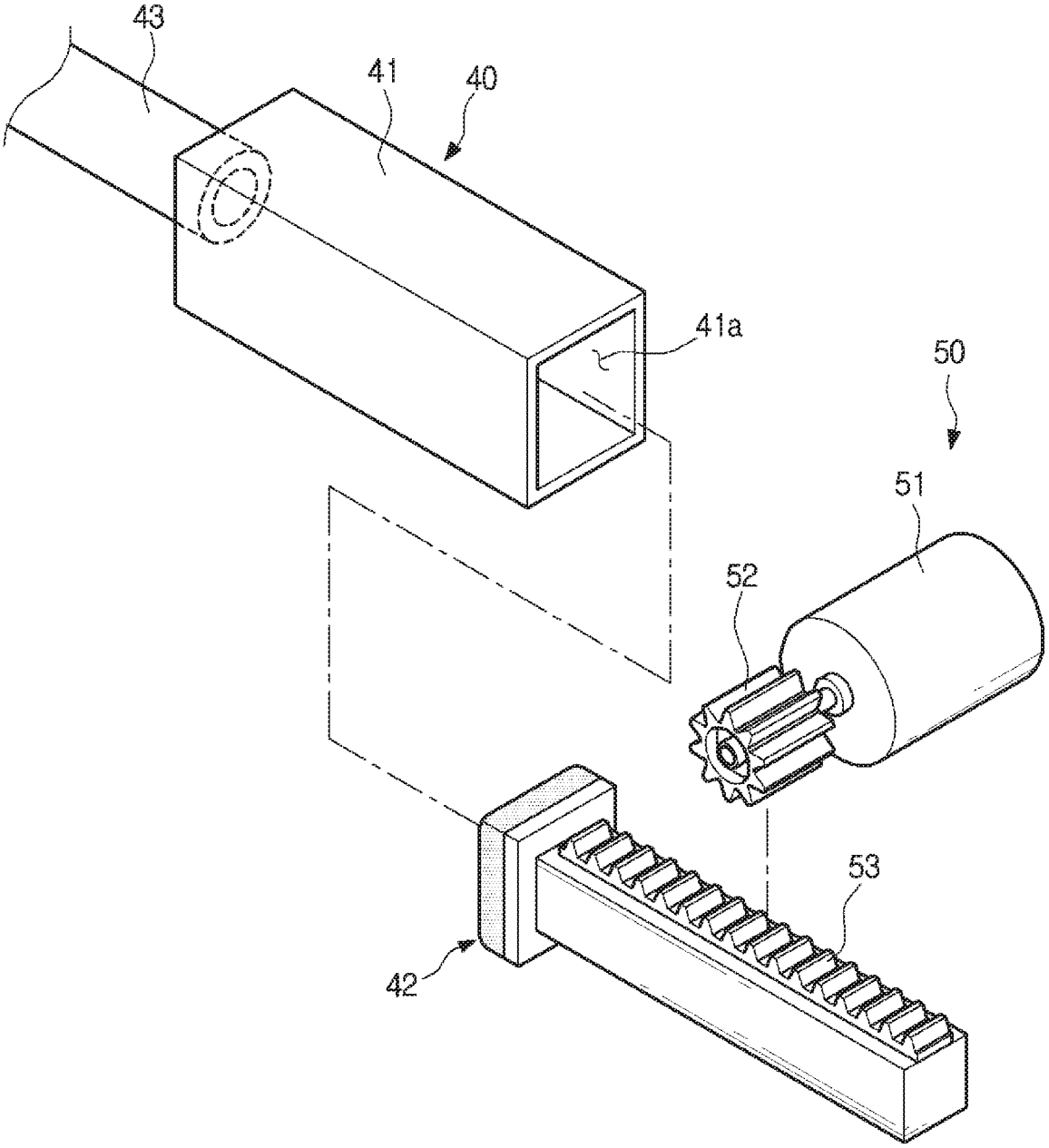
FIG. 3 is an exploded perspective view illustrating a resonator applied to the vacuum cleaner according to the first embodiment of the present disclosure.

As illustrated in FIG. 3, the resonator 40 may include a resonance container 41 formed in a hollow container shape to form a resonance space 41*a*; a piston 42 installed to be movable in the resonance container 41 to change a volume of the resonance space 41*a* inside of the resonance container 41; and a connection pipe 43 configured to connect the flow path 13 and 14 to the resonance container 41. Therefore, the volume of the resonance space 41*a* may be changed according to the movement of the piston 42, and thus the resonant frequency of the resonator 40 may be changed. According to the embodiment, the inside of the resonance container 41 may have an approximately rectangular shape but the shape of the resonance container 41 is not limited thereto. Therefore, the inside of the resonance container 41 may be formed in various other shapes, e.g., a cylindrical shape.

The resonant frequency of the resonator 40 can be calculated through the following equation. In the following equation, "fr" represents a resonant frequency, "A" represents a cross-sectional area of a connection pipe, "l" represents a length of a connection pipe, "V" represents a volume of the resonance space 41*a* and "c" represents the speed of sound.

$$fr = \frac{c}{2\pi}\sqrt{\frac{A}{l \times V}}\ \text{Hz}$$

Therefore, it may be possible to effectively cancel the noise generated in the flow path 13 and 14 by changing the volume of the resonance space 41*a* inside of the resonance container 41 by moving the piston 42 to correspond to the rotational speed of the motor 21.

The piston 42 may be moved by the power generated by a driving device 50. According to the embodiment, the driving device 50 may include a driving motor 51; a pinion 52 mounted on a shaft of the driving motor 51; and a rack 53 mounted on the piston 42 and engaged with the pinion 52. Therefore, as the pinion 52 rotates in the forward and reverse directions by the driving motor 51, the rack 53 may move and accordingly the piston 42 may move in the resonance container 41 to change the volume of the resonance space 41*a*. According to the embodiment, the driving device 50 may be configured with the driving motor 51, the pinion 52 and the rack 53, but is not limited thereto. Therefore, the variety of driving devices may be used to move the piston 42.

Figure 4:
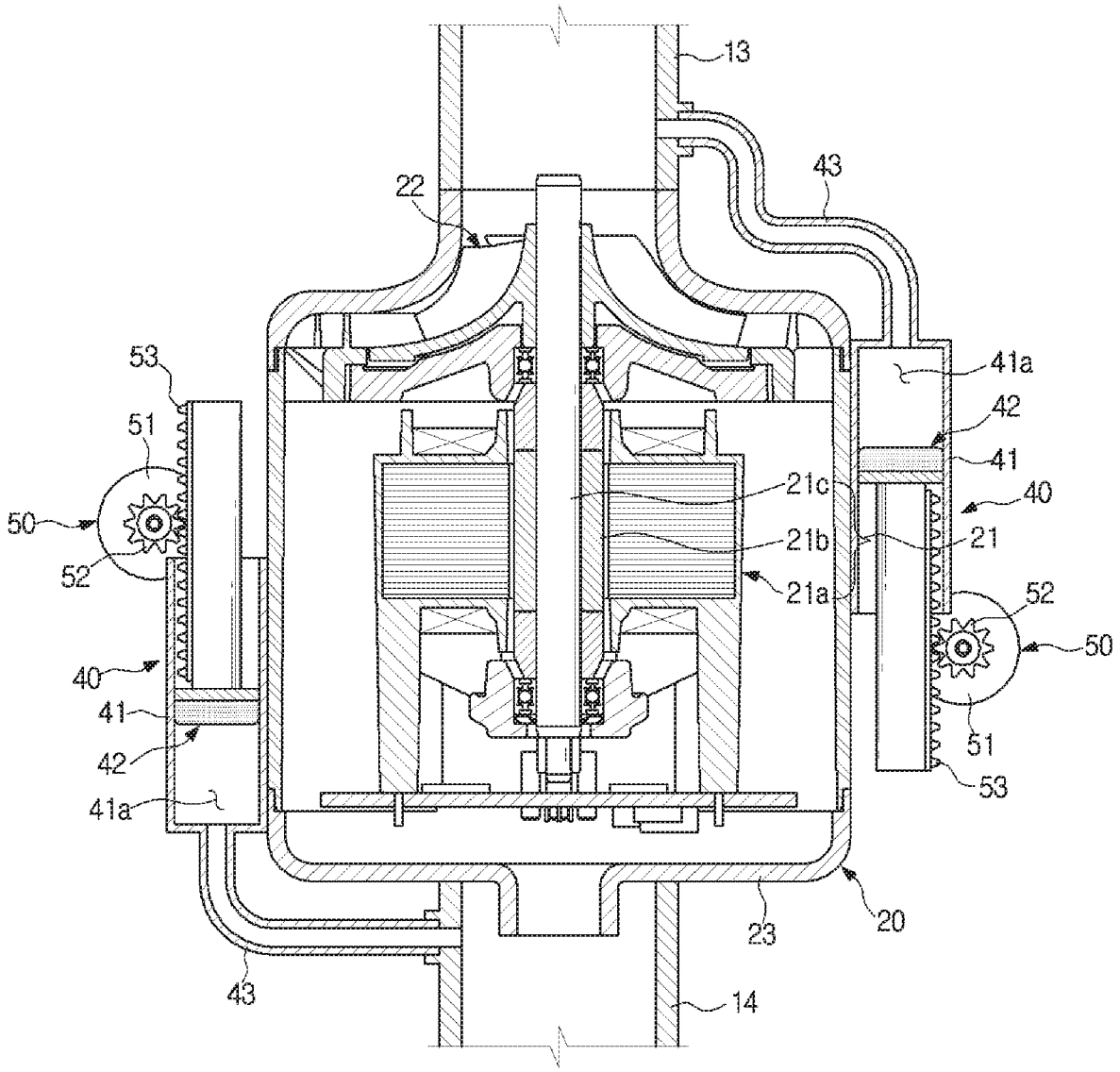
FIG. 4 is a sectional view illustrating an operation of the resonator applied to the vacuum cleaner according to the first embodiment of the present disclosure.

As illustrated in FIG. 2, when the volume of the resonance space 41*a* is formed to be large by the piston 42, the frequency of the noise, which is to be cancelled by the resonator 40, may be relatively low, and as illustrated in FIG. 4, when the volume of the resonance space 41*a* is formed to be small by the piston 42, the frequency of the noise, which is to be cancelled by the resonator 40, may be relatively high. Therefore, although the frequency of the noise, which is generated in the suction flow path 13 and the discharge flow path 14, is changed according to the change in the operation mode of the vacuum cleaner 1, it may be possible to change the resonant frequency of the noise of the resonator 40 to correspond to the frequency of the noise by moving the piston 42, and thus it may be possible to effectively deal with the noise generated in the flow path 13 and 14.

Figure 5:
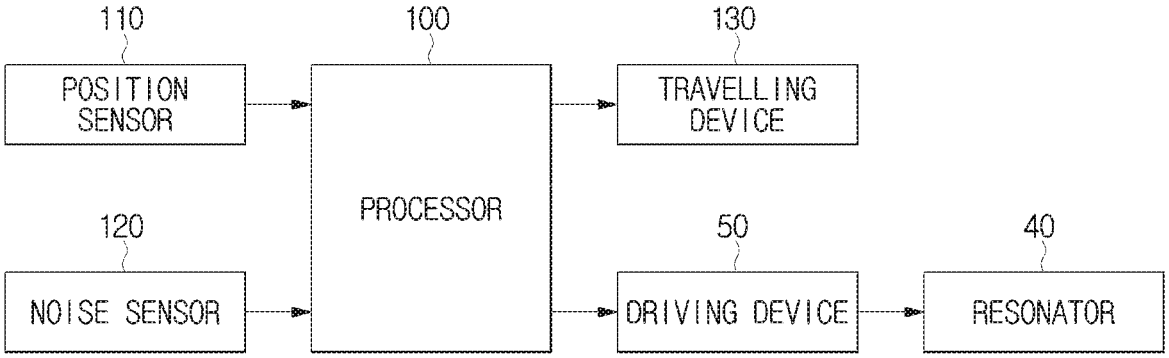
FIG. 5 is a control block diagram of a vacuum cleaner according to the first embodiment of the present disclosure.

As illustrated in FIG. 5, the vacuum cleaner 1 may include a processor 100 configured to control motions of the vacuum cleaner 1; a position sensor 110 configured to detect a wall, an obstacle and a floor; and a travelling device 130 configured to allow the vacuum cleaner 1 to automatically move by including a travelling motor (not shown) generating a torque and a wheel (not shown) rotating by receiving the torque from the travelling motor.

Therefore, the vacuum cleaner 1 may perform a cleaning while travelling through the travelling device to avoid a collision or falling using the information about the wall, the obstacle and the floor detected by the position sensor 110.

The vacuum cleaner 1 may include a noise sensor 120 configured to detect a noise generated in the suction flow path 13 and the discharge flow path 14 during the suction unit 20 is operated. Therefore, the processor 100 may receive information about the noise sensed by the noise sensor 120 and then control the resonator 40 so that the resonator 40 has a resonance frequency corresponding to the frequency of the noise sensed by the noise sensor 120. In this embodiment, the processor 100 may control the driving device 50 to move the piston 42, thereby changing the volume of the resonance space 41*a* provided inside the resonance container 41.

Therefore, when a user operates the vacuum cleaner 1, the suction unit 20 may suction air via the suction flow path 13 and discharge the air via the discharge flow path 14. In the process of suctioning and discharging of the air, the noise may be generated in the suction flow path 13 and the discharge flow path 14. The frequency of the noise may be detected by the noise sensor 120 and the information of the frequency of the noise may be transmitted to the processor 100. The processor 100 may move the piston 42 by controlling the driving device 50 to change the volume of the resonance space 41*a* in the resonance container 41. As the volume of the resonance space 41*a* is changed, the resonant frequency of the resonator 40 may be changed to correspond to the frequency of the noise generated in the suction flow path 13 and the discharge flow path 14 so as to cancel the noise generated in the flow path 13 and 14.

The control method of the vacuum cleaner will be described below.

Figure 6:
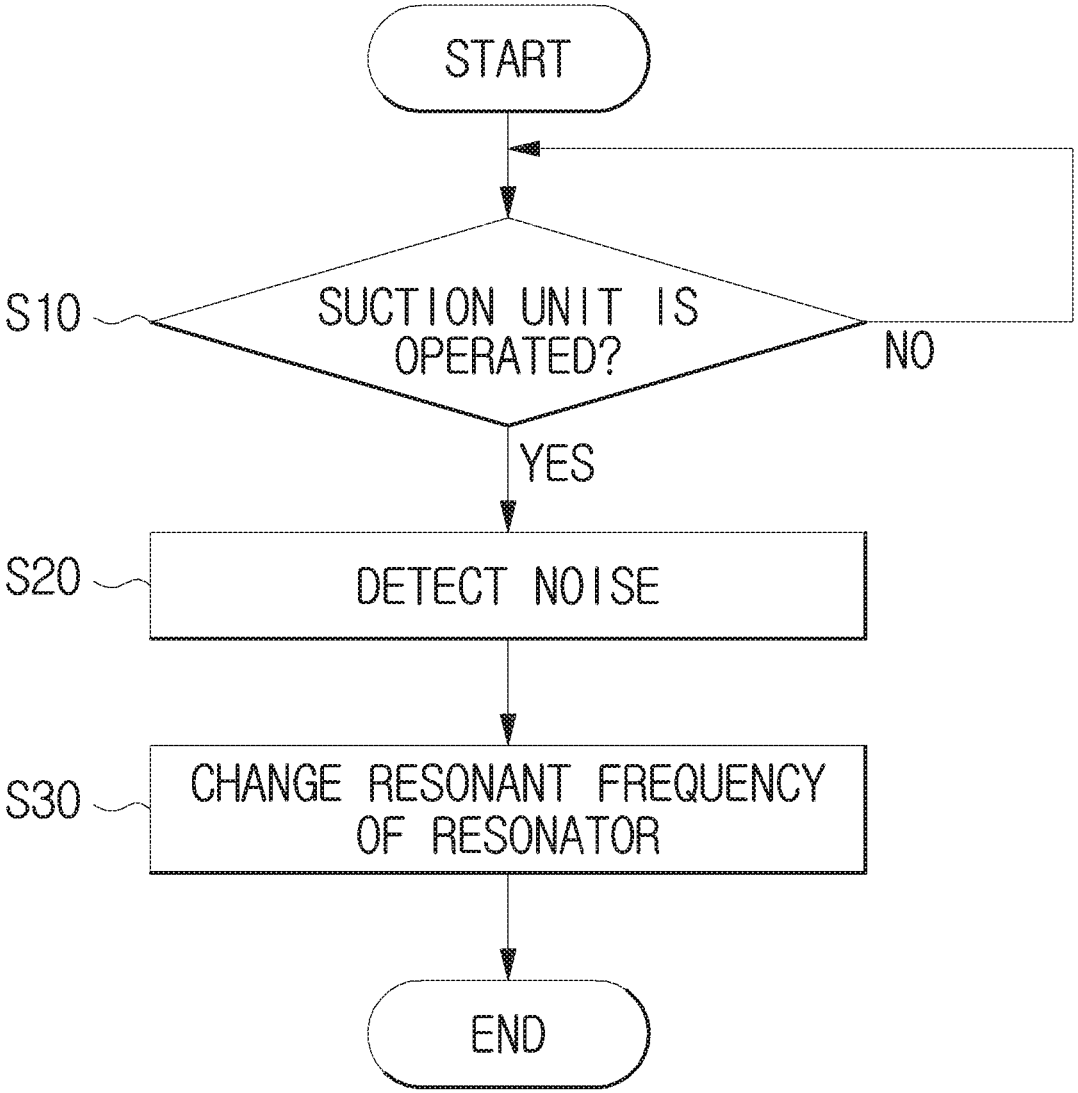
FIG. 6 is a control flowchart of the vacuum cleaner according to the first embodiment of the present disclosure.

As illustrated in FIG. 6, it may be checked whether the suction unit 20 is operated or not (10), and when it is checked that the suction unit 20 is operated, the noise sensor 120 may detect the frequency of the noise generated in the flow path 13 and 14 (20).

The processor 100 may receive the information about the frequency of the noise detected by the noise sensor 120 and then allow the resonant frequency of the resonator 40 to be changed to correspond to the frequency of the noise detected by the noise sensor 120 (30). According to the embodiment, the driving device 50 may allow the volume of the resonance space 41*a* in the resonance container 41 to be changed by moving the piston 42. According to the embodiment, the change in the resonant frequency of the resonator 40 may be performed by changing the volume of the resonance space 41*a* in the resonance container 41, but is not limited thereto. Therefore, according to a third embodiment described later, the change in the resonant frequency of the resonator 40 may be performed by changing a length of a connection pipe 43-2.

According to the embodiment, it may be possible to change the resonant frequency of the resonator 40 by detecting the noise using the noise sensor 120, but is not limited thereto. Since the frequency of the noise is indirectly detected by using the flow rate of the air passing through the suction flow path 13 and the discharge flow path 14, the vacuum cleaner 1 may include a flow rate sensor (not shown) configured to detect the flow rate of the air passing the suction flow path 13 and the discharge flow path 14.

Alternatively, without a configuration corresponding to the noise sensor 120, the vacuum cleaner 1 may allow the resonant frequency of the resonator 40 to be changed to a predetermined value according to the operation mode selected by a user.

According to the embodiment, the resonator 40 is installed in the suction flow path 13 and the discharge flow path 14, respectively, but is not limited thereto. It may be possible to install the resonator 40 in any one of the suction flow path 13 and the discharge flow path 14. Alternatively, it may be possible to install the resonator 40 configured to change the resonant frequency, in any one of the suction flow path 13 and the discharge flow path 14 and to install a general resonator configured to cancel a certain resonate frequency, in the other of the suction flow path 13 and the discharge flow path 14.

Figure 7:
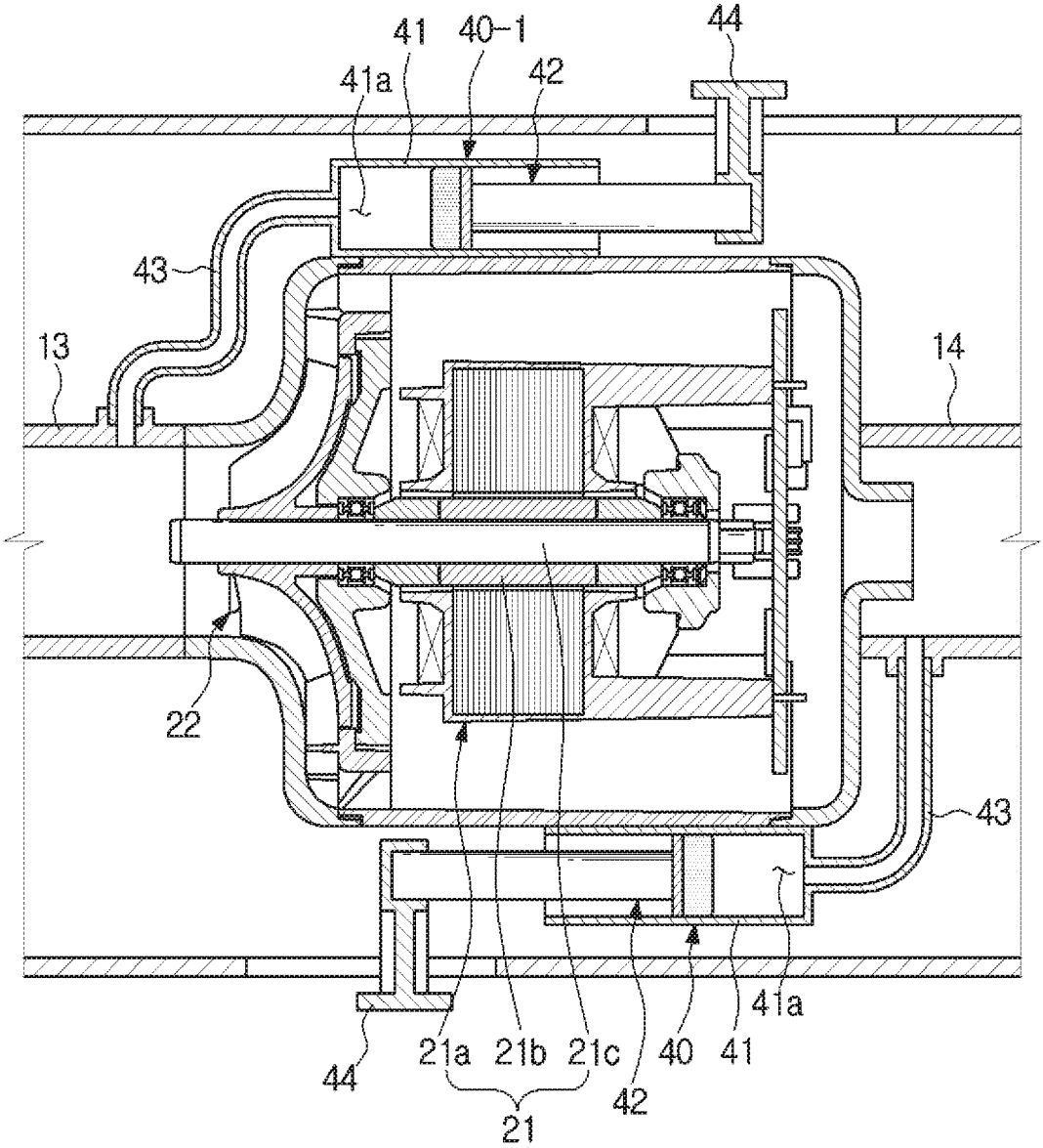
FIG. 7 is a sectional view illustrating a suction unit and a resonator applied to a vacuum cleaner according to a second embodiment of the present disclosure.

According to the first embodiment, the piston 42 may be moved forward and backward by the piston 42 using the power generated by the driving device 50, but is not limited thereto. According to a second embodiment as illustrated in FIG. 7, the piston 42 may be connected to a lever 44 exposed to the outside of the body 10 of the vacuum cleaner 1 so that a user may move the piston 42 by directly applying a force to the piston 42 of a resonator 40-1 through the lever 44.

Figure 8:
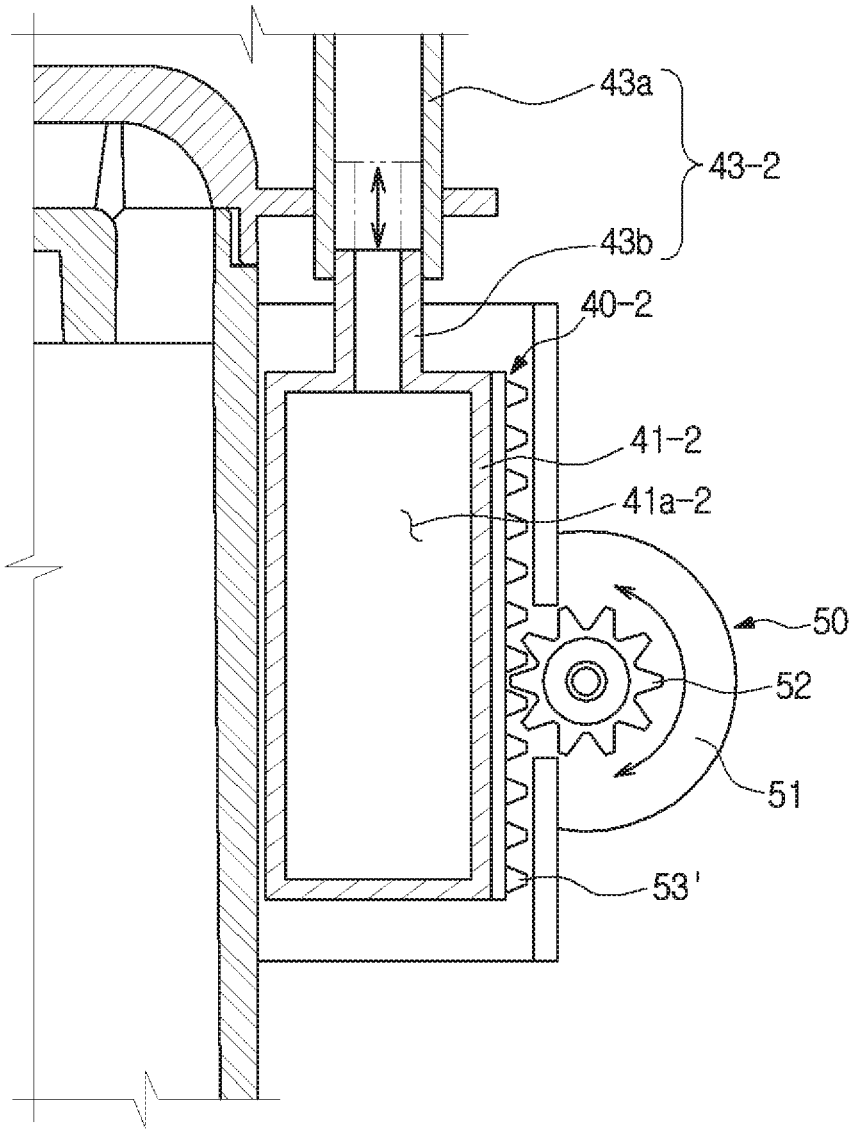
FIG. 8 is a cross-sectional view illustrating a resonator applied to a vacuum cleaner according to a third embodiment of the present disclosure.

According to the above mentioned embodiments, the resonant frequency may be changed by changing the volume of the resonance space 41*a* by moving the piston 42, but is not limited thereto. According to the third embodiment as illustrated in FIG. 8, it may be configured to change a length of a connection pipe 43-2 while maintaining a volume of a resonance space 41*a*-2 inside of a resonance container 41-2, and thus it may be possible to change the resonant frequency of a resonator 40-2 by changing a length of the connection pipe 43-2.

According to the third embodiment, the connection pipe 43-2 applied to the vacuum cleaner 1 may include a first connection pipe 43*a* connected to the flow path 13 and 14; and a second connection pipe 43*b* connected to the resonance container 41-2 and movably installed in the first connection pipe 43*a*. The driving device 50 may include a driving motor 51 and a pinion 52 and a rack 53, wherein the rack 53 may be installed in the resonance container 41-2.

When moving the resonance container 41-2 using the driving device 50, the resonance container 41-2 together with the second connection pipe 43*b* may be moved and thus an entire length of the connection pipe 43-2 may be changed. Accordingly, the resonant frequency of the resonator 40-2 may be changed.

Figure 9:
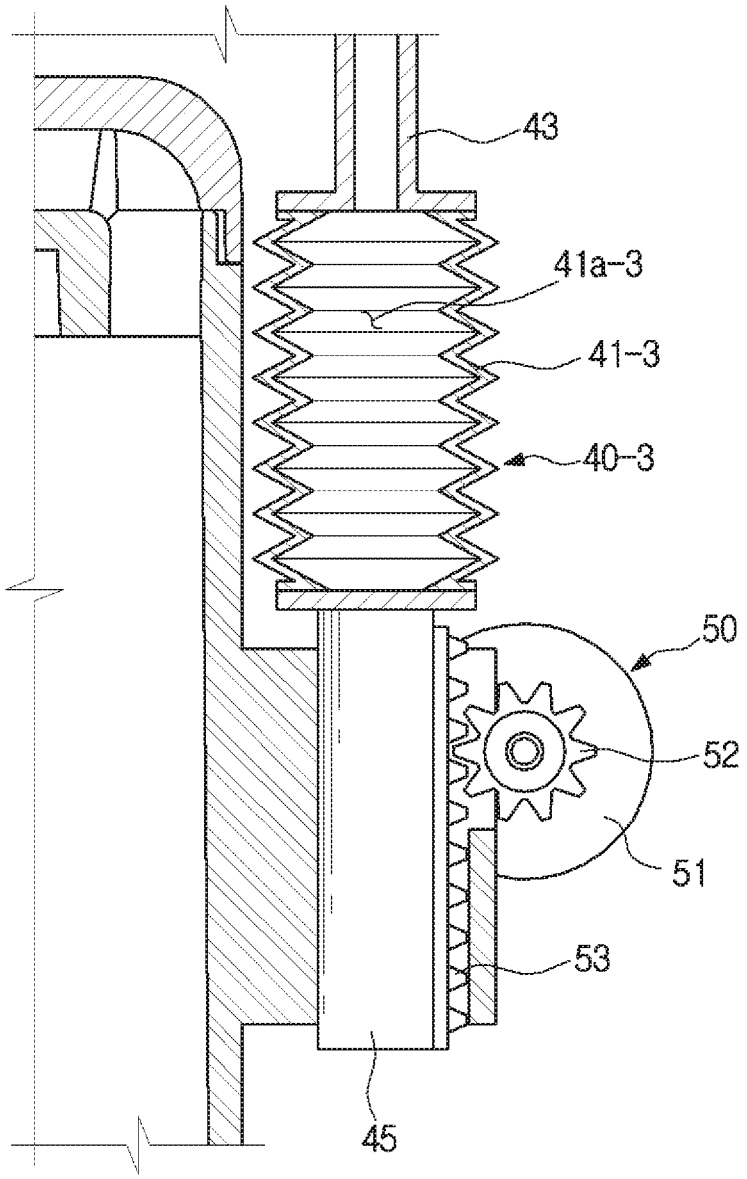
FIGS. 9 and 10 are sectional views illustrating operations of a resonator applied to a vacuum cleaner according to a fourth embodiment of the present disclosure.
Figure 10:
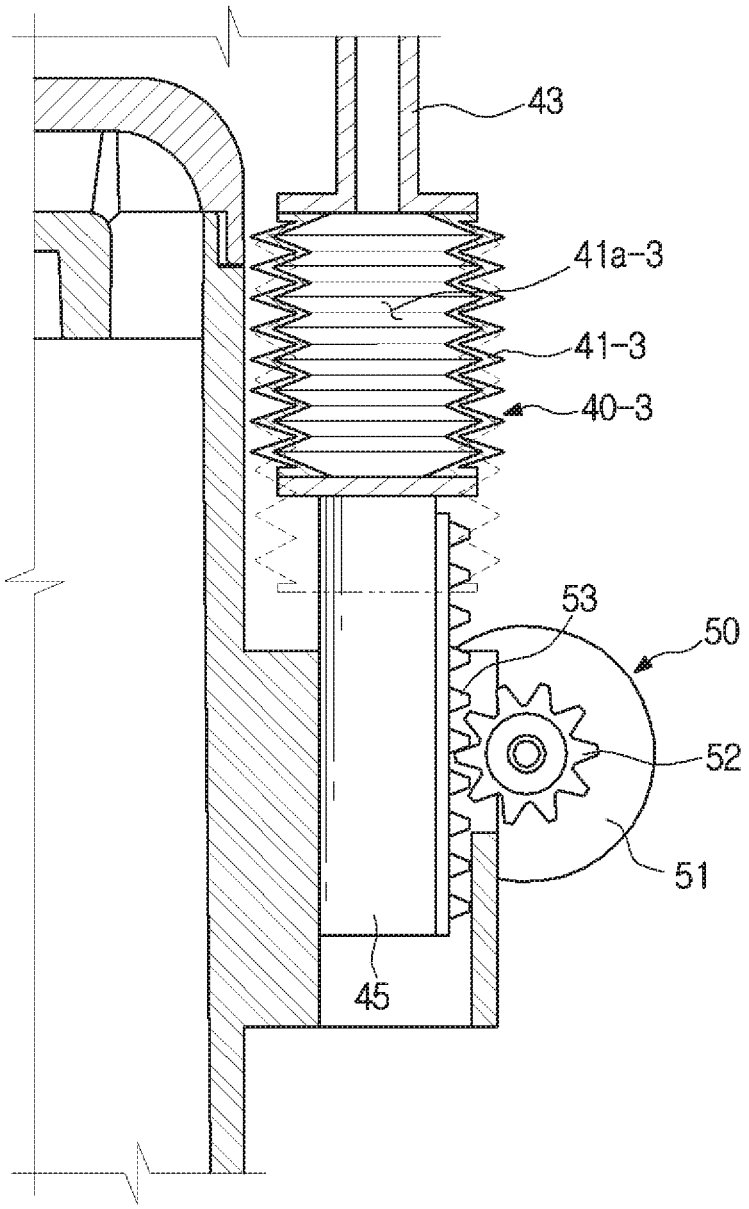

FIGS. 9 and 10 illustrate a resonator 40-3 applied to a vacuum cleaner 1 according to a fourth embodiment of the present disclosure.

The resonator 40-3 may include a resonance container 41-3 formed by an expandable and contractible bellows tube; a guide rod 45 installed on one side of the resonance container 41-3 to guide the expansion and the contraction of the resonance container 41-3; and a driving device 50 configured to transfer the guide rod 45. The driving device 50 may include a driving motor 51 and a pinion 52 and a rack 53, as the same as the above mentioned embodiment, wherein the rack 53 may be installed in the guide rod 45. When the guide rod 45 is moved by the driving device 50, the resonance container 41-3 may be contracted and thus the volume of a resonance space 41*a*-3 provided therein may be changed. Accordingly, the resonant frequency, which is to be cancelled by the resonator 40-3 may be changed.

Figure 11:
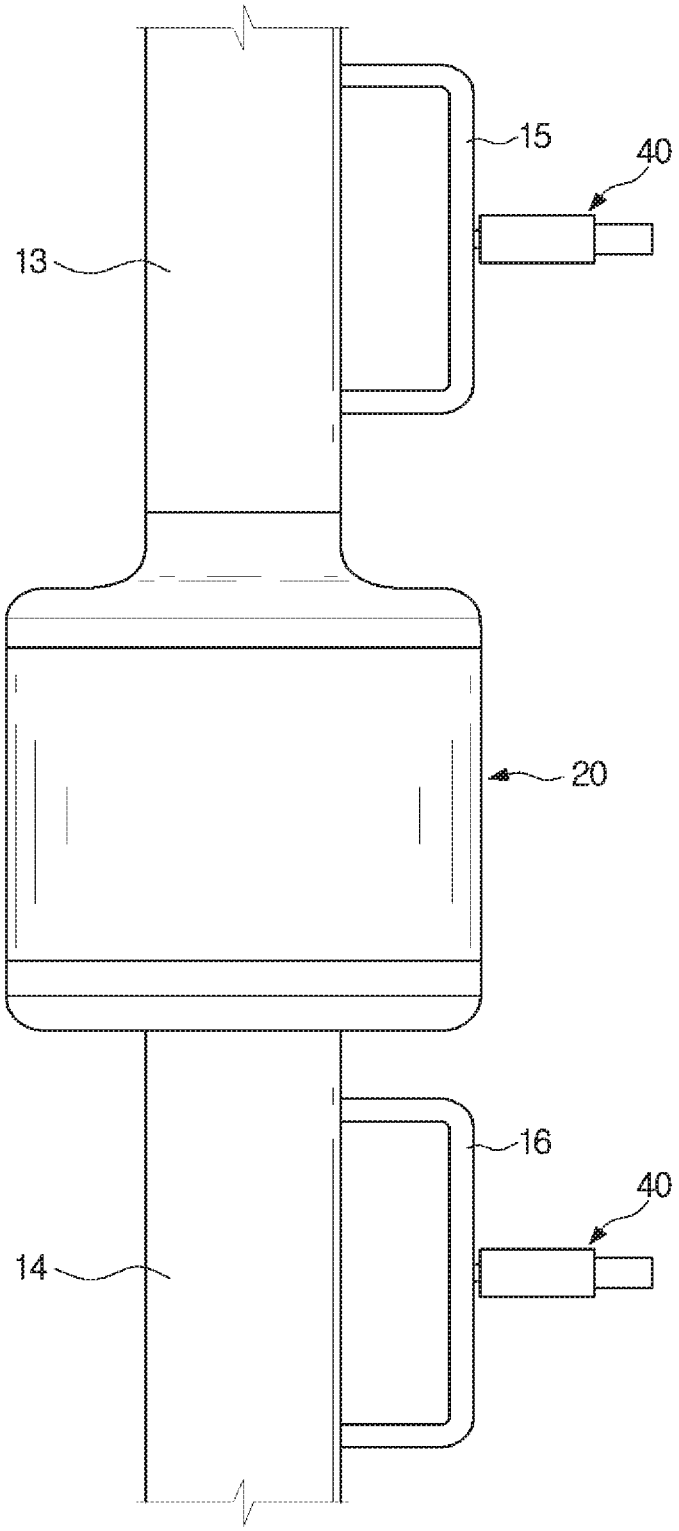
FIG. 11 is a schematic view illustrating an installation state of a resonator applied to a vacuum cleaner according to a fifth embodiment of the present disclosure.

FIG. 11 illustrates a state in which a resonator 40 applied to a vacuum cleaner 1 is installed according to a fifth embodiment of the present disclosure.

According to the embodiment, a vacuum cleaner 1 may include a main flow path, i.e., a suction flow path 13 and a discharge flow path 14 directly connected to a suction unit 20 and two bypass flow paths 15 diverged from the suction flow path 13 or the discharge flow path 14 and then joined into the suction flow path 13 or the discharge flow path 14, wherein the resonator 40 may be installed in the two bypass flow paths 15. The bypass flow path 15 may have a smaller diameter than the suction flow path 13 and the discharge flow path 14 so that most of the air flows via the suction flow path 13 and the discharge flow path 14.

When it is impossible to secure a space in the surround of the suction flow path 13 and the discharge flow path 14 for installing the resonator 40, the resonator may be directly connected to the suction flow path 13 or the discharge flow path 14 using the bypass flow path 15.

According to the embodiment, two bypass flow paths 15 are provided and then a single bypass flow path 15 is connected to the suction flow path 13 and the discharge flow path 14, respectively, but is not limited thereto. Alternatively, a single bypass flow path 15 may be connected to any one of the suction flow path 13 and the discharge flow path 14. In this case, the resonator 40 may be directly connected to the suction flow path 13 or the discharge flow path 14 to which the bypass flow path 15 is not connected, and alternatively, the resonator 40 may be not connected to the suction flow path 13 or the discharge flow path 14 to which the bypass flow path 15 is not connected.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A vacuum cleaner comprising:
- a suction unit configured to suction and discharge air;
- a suction flow path configured to guide air to be suctioned into the suction unit;
- a discharge flow path configured to guide air to be discharged from the suction unit;
- a suction resonator connected to the suction flow path to cancel a suction noise;
- a discharge resonator connected to the discharge flow path to cancel a discharge noise; and
- a processor configured to:
  - receive an operation mode of the vacuum cleaner, and control, based on the operation mode of the vacuum cleaner, the suction resonator to change a resonant frequency of the suction flow path to be canceled and the discharge resonator to change a resonant frequency of the discharge flow path to be canceled.

2. The vacuum cleaner of claim 1, wherein the suction resonator comprises:
- a resonance container formed in a hollow container shape to form a resonance space; and
- a piston installed to be movable forward and backward in the resonance container.

3. The vacuum cleaner of claim 2, further comprising:
- a driving device configured to move the piston forward and backward.

4. The vacuum cleaner of claim 3, wherein the driving device comprises:
- a driving motor;
- a pinion rotated by the driving motor; and
- a rack connected to the piston and engaged with the pinion.

5. The vacuum cleaner of claim 2, further comprising:
- a lever configured to transmit an external force to the piston.

6. The vacuum cleaner of claim 2, wherein:
- the suction resonator comprises:
  - a resonance container formed in a hollow container shape to form a resonance space; and
  - a connection pipe configured to connect the suction flow path to the resonance container, and
- a length of the connection pipe is variable.

7. The vacuum cleaner of claim 6, wherein the connection pipe comprises:
- a first connection pipe extending from the suction flow path; and a second connection pipe extending from the resonance container and movably installed in the first connection pipe.

8. The vacuum cleaner of claim 1, wherein the suction resonator and the discharge resonator are changed to different resonant frequencies.

9. The vacuum cleaner of claim 1, wherein the suction flow path comprises:

a main flow path; and a bypass flow path diverged from the main flow path and then joined into the main flow path, and the suction resonator is connected to the bypass flow path.

10. The vacuum cleaner of claim 1, wherein the suction resonator comprises a resonance container formed by an expandable and contractible bellows tube.

11. A vacuum cleaner comprising:

a suction flow path configured to guide suction of air;

a discharge flow path configured to guide discharge of air;

a suction resonator connected to the suction flow path; and a discharge resonator connected to the discharge flow path, wherein the suction resonator comprises a suction resonance container forming a suction resonance space and the discharge resonator comprises a discharge resonance container forming a discharge resonance space; and a processor configured to:

receive an operation mode of the vacuum cleaner, and control, based on the operation mode of the vacuum cleaner, the suction resonator to change a volume of the suction resonance space and the discharge resonator to change a volume of the discharge resonance space.

12. The vacuum cleaner of claim 11, further comprising:

a piston installed to be movable in the suction resonance container and configured to change the volume of the suction resonance space while moving.

13. The vacuum cleaner of claim 11, wherein the suction resonance container is formed by an expandable and contractible bellows tube.

14. A vacuum cleaner comprising:

a suction flow path configured to guide suction of air;

a discharge flow path configured to guide discharge of air;

a suction resonator connected to the suction flow path, wherein the suction resonator comprises a suction resonance container forming a suction resonance space and a suction connection pipe connecting the suction flow path to the suction resonance container, wherein a length of the suction connection pipe is variable;

a discharge resonator connected to the discharge flow path, wherein the discharge resonator comprises a discharge resonance container forming a discharge resonance space and a discharge connection pipe connecting the discharge flow path to the discharge resonance container, wherein a length of the discharge connection pipe is variable; and a processor configured to:

receive an operation mode of the vacuum cleaner, and control, based on the operation mode of the vacuum cleaner, the length of the suction connection pipe and the length of the discharge connection pipe.

15. The vacuum cleaner of claim 14, wherein the suction connection pipe comprises:

a first connection pipe extending from the suction flow path; and a second connection pipe extending from the suction resonance container and movably installed in the first connection pipe.

16. A control method for a vacuum cleaner comprising:

allowing air to flow via a flow path by driving a suction unit, wherein the flow path includes a suction flow path and a discharge flow path;

detecting a frequency of noise generated in the flow path during the air flows; and changing, based on an operation of the vacuum cleaner, a resonant frequency of a suction resonator connected to the suction flow path and a resonant frequency of a discharge resonator connected to the discharge flow path in a manner that both of the resonant frequencies corresponds to the frequency of the noise.

17. The control method of claim 16, wherein:

the suction resonator comprises a resonance container formed in a hollow container shape to form a resonance space therein, and the change in the resonant frequency of the suction resonator is performed according to the change in a volume of the resonance space.

18. The control method of claim 16, wherein:

the suction resonator comprises a connection pipe configured to connect the flow path to a resonance container, and the change in the resonant frequency of the suction resonator is performed according to the change in a length of the connection pipe.

* * * * *